US007078144B2

(12) United States Patent
Ota et al.

(10) Patent No.: US 7,078,144 B2
(45) Date of Patent: Jul. 18, 2006

(54) METHOD FOR MANUFACTURING TONER

(75) Inventors: Nobuyasu Ota, Tokyo (JP); Toshihiko Yamato, Tokyo (JP)

(73) Assignee: Zeon Corporation, Tokyo (JP)

( * ) Notice: Subject to any disclaimer, the term of this patent is extended or adjusted under 35 U.S.C. 154(b) by 96 days.

(21) Appl. No.: 10/736,556

(22) Filed: Dec. 17, 2003

(65) Prior Publication Data

US 2004/0253531 A1 Dec. 16, 2004

(30) Foreign Application Priority Data

Dec. 17, 2002 (JP) ..... 2002-365558

(51) Int. Cl.
*G03G 5/00* (2006.01)

(52) U.S. Cl. ..... 430/137.2; 430/137.18; 430/137.12; 430/137.15; 430/137.16

(58) Field of Classification Search ..... 430/137.2, 430/137.18, 137.12, 137.15, 137.16
See application file for complete search history.

(56) References Cited

U.S. PATENT DOCUMENTS 6,171,744 B1 * 1/2001 Nakazawa et al. ..... 430/108.6

FOREIGN PATENT DOCUMENTS

| | | |
|---|---|---|
| JP | 2000-042494 | 2/2000 |
| JP | 2001-104888 | 4/2001 |
| JP | 2001-293438 | 10/2001 |

* cited by examiner

*Primary Examiner*—Mark A. Chapman
(74) *Attorney, Agent, or Firm*—Armstrong, Kratz, Quintos, Hanson & Brooks, LLP

(57) ABSTRACT

The present invention relates to a method for manufacturing a toner with adjusted particle size distribution having a step of preparing colored particles that contain a binder resin and a colorant, and a step of classifying the colored particles. In the classification step, a classifier that has a plurality of vane-wheel classifying rotors coaxially in a casing, enables the rotating speed of each classifying rotor to be set to be the same as or different from each other, and can simultaneously perform a plurality of stages of classification corresponding to each classifying rotor is used; and the powder material comprising colored particles to which a fluidizing agent is added is fed to the classifier to perform classification.

16 Claims, 1 Drawing Sheet

METHOD FOR MANUFACTURING TONER

FIELD OF THE INVENTION

The present invention relates to a method for manufacturing a toner composed of colored polymer particles, and more preferably to a method for manufacturing a toner that can be classified to desired particle size distribution and can form high-quality images with high density and little fog even in continuous printing.

According to the manufacturing method of the present invention, fine particles can be efficiently removed by classification even from the toner of small particle sizes having strong coagulating characteristics, and a high-quality toner can be obtained at a high yield.

BACKGROUND OF THE INVENTION

In image forming machines such as electrographic or electrostatic copying machines, laser-beam printers, and facsimiles, a developer is used for visualizing electrostatic latent images formed on a photoreceptor. As the developer, a toner composed of colored polymer particles containing at least a binder resin and a colorant is used.

Toners are roughly divided into pulverized toners obtained by a pulverizing method and polymerized toners obtained by a polymerization method.

In the pulverizing method, a pulverized toner is obtained by melting and kneading a thermoplastic resin together with additive components such as a colorant, a charge control agent, and a release agent, and pulverizing and classifying the mixture.

In the polymerization method, a polymerized toner is obtained by polymerizing a polymerizable monomer composition containing polymerizable monomers, a colorant, and other additive components in an aqueous medium, and coagulating the composition as required, to obtain a polymerized toner as colored polymer particles. In the polymerized toner, the polymer component formed by the polymerizable monomer becomes a binder resin.

A toner is required to form delicate and high-density images of excellent image quality, not to deteriorate the image quality even by change in ambient conditions such as temperature and humidity, and to be able to perform continuous printing and continuous copying. The toner is also demanded to improve the fixation properties such as lowered fixing temperature without lowering shelf stability to satisfy the requirements of energy saving, and color printing and copying. Furthermore, as the requirement level for high resolution and high image quality is elevated, the tendency to reduce the particle size of the toner has been enhanced.

Since the particle size distribution of the pulverized toner obtained by the pulverizing method is wide, the toner must be classified to have desired particle size distribution to obtain high-quality images.

By the polymerization method, on the other hand, a polymerized toner composed of spherical particles having sharp particle size distribution can be manufactured. In addition, according the polymerization method, colored polymer particles of a core-shell structure can be formed by a polymerizable monomer for the shell in the presence of the formed colored polymer particles after a polymerizable monomer composition has been polymerized; whereby the polymerized toner of excellent fixation properties can be manufactured without deteriorating shelf stability. Furthermore, according to the polymerization method, a polymerized toner having a small particle size, for example, of the volume average particle size of 10 μm or less, or even 3 to 8 μm can be easily manufactured.

However, even by the polymerization method, the formation of fine particles cannot be prevented completely, and especially in the case of the polymerized toner of a small particle size, fine particles is easily formed causing fog and image quality lowering. Therefore, the removal of fine particles by classification has become an essential technical problem for raising the resolution of the polymerized toner, and for obtaining fine and high-quality images.

However, in not only pulverized toners, but also polymerized toners, as the particle sizes thereof are reduced, the coagulating properties tend to intensify due to the action of intermolecular force. As a result, the dispersibility or fluidity of toners of small particle sizes is deteriorated.

On the other hand, the classification of the toner is generally performed by the method for mechanically classifying the material colored polymer particles using various classifiers such as airflow classifiers and mechanical centrifugal wind classifiers. However, when colored polymer particles having large coagulation properties is supplied to a classifier, since the colored polymer particles are difficult to be dispersed to the state close to primary particles in the classifier, the highly accurate classification becomes difficult, and the toner having desired particle size distribution cannot be obtained efficiently at a high yield.

There has been known an airflow classifier equipped with a material supply nozzle having an opening in the classifying zone to inject the powder material in the material supply nozzle to the classifying zone by the air flowing in the material supply nozzle, and to classify the powder material into at least coarse particles and fine particles by the inertial force of the particles of the powder material in the injected airflow and the Coanda effect (Japanese Patent Laid-Open No. 2000-42494). This reference proposes the methods to lower the liquid cross-linking force of the powder material in the airflow when the toner is classified using the airflow classifier (also referred to as "elbow-jet classifier") by lowering the moisture content in the airflow by controlling humidity; and to raise the classification accuracy by raising the fluidity and dispersibility of the powder material. However, the use of the airflow classifier is difficult to efficiently remove fine particles from the toner of small particle sizes even if the fluidity and dispersibility of the powder material is raised.

There has also been known a classifier having a rotatably borne drive shaft and a classifying rotor mounted to the drive shaft, and classifying powder or granules by coaxially rotating the classifying rotor synchronizing the rotation of the drive shaft (Japanese Patent Laid-Open No. 2001-104888). This classifier is a "mechanical centrifugal air classifier" for classification by the balance of the centrifugal force by the vane provided in the rotating rotor with the centripetal force by the suction of the fan. This reference proposes to carry out the surface treatment for preventing the adhesion of the powder or granules to the classifying rotor. However, even the use of this classifier is difficult to efficiently remove fine particles from the toner having a small particle size and having strong coagulation properties.

Furthermore, there has been known a classifier for classifying pulverized powder material having a plurality of vane-wheel classifying rotors on the same axis in a casing, wherein the rotation speed of each classifying rotor can be set to be the same or different from each other, and performs a plurality of stages simultaneously corresponding to each classifying rotor (Japanese Patent Laid-Open No. 2001-293438) This reference describes that the use of this classifier avoids the pulverization of powder materials, the powder material is optimally dispersed between the classifying zones, and the mass present in some cases, and the classification can be performed within an obvious particle size range. However, even the use of this classifier is difficult to efficiently remove fine particles from the toner having a small particle size and having strong coagulation properties.

SUMMARY OF THE INVENTION

The object of the present invention is to provide a method for manufacturing a toner that can be classified to desired particle size distribution, and can form high-quality images of high density and little fog even after continuous printing.

Specifically, the object of the present invention is to provide a method for manufacturing a toner to obtain a high-quality toner at high yield by classifying to efficiently remove fine particles even from a toner of small particle sizes that has strong coagulating properties.

The present inventors conducted repeated examinations to achieve the above-described objects, and found that it is effective to classify colored polymer particles using a classifier having a plurality of vane-wheel classification rotors coaxially in a casing as disclosed in Japanese Patent Laid-Open No. 2001-293438, when a powder material composed of colored polymer particles to which a fluidizing agent is added is supplied to the classifier for classification.

As the fluidizing agent, it is preferable to use organic or inorganic fine particles generally used in non-magnetic single-component developers and the like as external additives for improving the fluidity of toners.

Surprisingly, even if a powder material whose fluidity has been improved by adding a fluidizing agent to colored polymer particles is used, the efficiency of removing fine particles is low and it is difficult to obtain high-quality toners when the powder material is classified using an elbow-jet classifier as disclosed in Japanese Patent Laid-Open No. 2000-42494, or other classifiers such as a mechanical centrifugal air classifier as disclosed in Japanese Patent Laid-Open No. 2001-104888. Therefore, the significant functional effect of the present invention is achieved by the selected combination of specific classifiers and colored polymer particles of improved fluidity. A small quantity of fine particles added as the fluidizing agent are removed together with the fine particles of colored polymer particles in the classification step. The present invention was completed on the basis of these findings.

According to the present invention, there is provided a method for the manufacture of a toner composed of colored polymer particles (B) whose particle-size distribution is adjusted, including Step 1 for preparing colored polymer particles (A) that contain at least a binder resin and a colorant, and Step 2 for classifying the colored polymer particles (A) wherein Step 2 is Step for performing classification by:

(i) using a classifier that has a plurality of vane-wheel classifying rotors coaxially in a casing; enables the rotating speed of each classifying rotor to be set to be the same as or different from each other; and can simultaneously perform a plurality of stages of classification corresponding to each classifying rotor; and (ii) feeding a powder material comprising colored polymer particles (A) , to which a fluidizing agent is added, to the classifier.

Also according to the present invention, a toner obtained by the above manufacturing method is provided.

DETAILED DESCRIPTION OF THE INVENTION

1. Classifier

Figure 1:
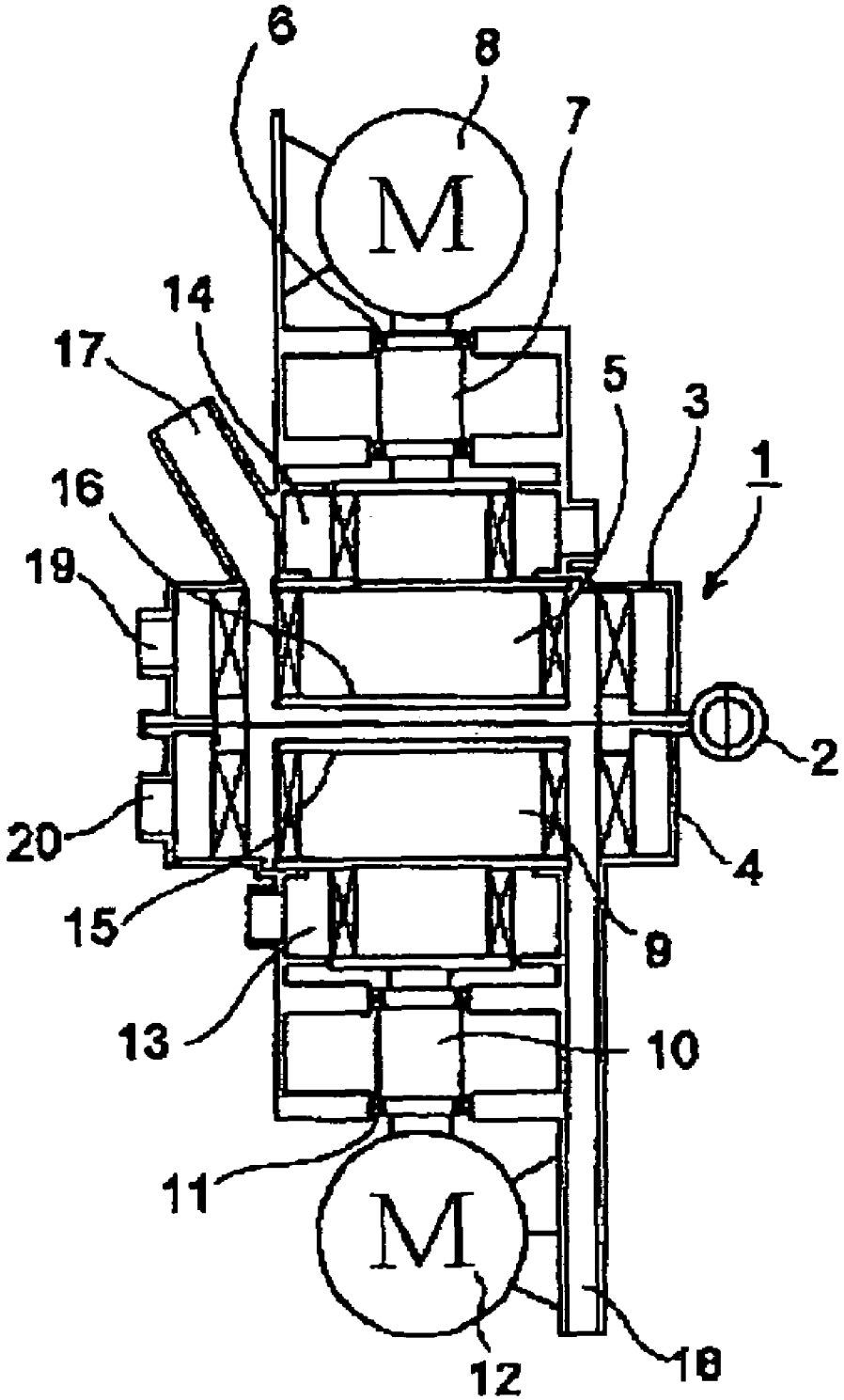
FIG. 1 is a sectional view showing an example of tandem classifiers used in the manufacturing method of the present invention.

The classifier used in the present invention is well known in the art, and disclosed in the above-described Japanese Patent Laid-Open No. 2001-293438 or the like. The classifier used in the present invention is a classifier that has a plurality of vane-wheel classifying rotors coaxially in a casing; enables the rotating speed of each classifying rotor to be set to be the same as or different from each other; and can simultaneously perform a plurality of stages of classification corresponding to each classifying rotor.

Such a classifier has preferably a tandem structure having two vane-wheel classifying rotors disposed coaxially and vertically in a casing. In other words, the preferable classifier is a tandem-type classifier having two motor-driven vane-wheel classifying rotors, each of which is mounted on one side in a common casing, and each provided with a tangential classifying-air intake at the level of respective classifying rotor; having a stationary guide vane ring that is positioned at a radial distance from the circumference of the classifying rotor; and having a feeder of the material to be classified, exit ports for discharging classified fractions, and a classifying zone through which a stream of the classified fractions flows along the direction of the longitudinal axis of the classifying rotor.

In this a tandem-type classifier, each classifying rotor is provided with a closed cover discat a first axial end thereof, and with a fine and medium fraction discharge port at a second axial end thereof; and the first end of each classifying rotor is disposed so as to face to each other, and a minute flow gap is formed in the axial direction thereof.

FIG. 1 is a sectional view showing an example of a tandem-type classifier. The tandem-type classifier 1 shown in FIG. 1 has casings 3 and 4 that can be divided, and can be rotatably opened around a hinge 2. The upper casing half 3 and the lower casing half 4 accommodates classifying rotors 5 and 9, respectively. In the upper casing half 3 of the classifying rotor 5, the drive shaft 7 is rotatably fitted in the bearing 6. The classifying rotor 5 is driven by a drive motor 8, and the drive motor 8 is connected to the classifying rotor 5 through the drive shaft 7.

Similarly in the lower casing half 4 coaxially and symmetrically facing the upper casing half 3, the drive shaft 10 of the classifying rotor 9 is rotatably fitted in the bearing 11. The classifying rotor 9 is driven by a drive motor 12, and the drive motor 12 is connected to the classifying rotor 9 through the drive shaft 10.

Each of the classifying rotors 5 and 9 is a classifying rotor mounted on one side, and respective drive shafts 7 and 10, fine-particle discharge chambers 14 and 13, and bearings 6 and 11 are located on the same side. The classifying rotors 5 and 9 are provided with closed cover discs 15 and 16, respectively.

A feed port 17 is located above the classifying rotor 5, through which, at a point along the perimeter, the granules to be classified are introduced. An exit port 18 for the coarse material is located underneath the classifying rotor 9. The classifying air is introduced at the radial perimeters of the classifying rotors 5 and 9 by way of the two tangential air intakes 19 and 20.

The cover discs 16 and 15 of respective classifying rotors are located at a distance in planes parallel to each other. In this state, the classifying rotors 5 and 9 rotate in the same direction. By equally adjusting the rotation speed of the classifying rotors 5 and 9, the material can be classified into fine particles and coarse particles. Furthermore, by adjusting the rotation speed of the classifying rotors 5 and 9 to be different, for example, fine particles, medium particles, and coarse particles can be taken out from the fine-particle discharge chamber 14, fine-particle discharge chamber 13, and exit port 18, respectively. The classifying rotors 5 and 9 can be rotated in the direction opposite to each other.

As the above-described tandem-type classifier, a TTSP Separator (tandem toner separator) marketed by Hosokawa Micron Corporation can be preferably used. The company also markets TSP separator (toner separator) using a single classifying rotor described in Japanese Patent Laid-Open No.2001-104888.

The TTSP Separator accelerates the dispersion of coagulated particles by the centrifugal force of two-stage rotors, and the effective classifying area of the classifying rotor is increased in the vertical direction, one-pass classification (classification by the continuous system) can be performed, and excels in fine-particle cutout performance. Furthermore, since the TTSP separator can be separable into the upper and lower rotors on the hinge, it can be easily disassembled and cleaned.

However, as described above, even if a TTSP separator is used, the efficiency of removing fine particles becomes insufficient, and processing capacity and the yield of classified product lower when small colored polymer particles having a volume average particle size of 10 μm or less, or 3 to 8 μm are classified. In the present invention, therefore, a material of improved fluidity by adding a fluidizing agent to the colored polymer particles is charged to the TTSP separator for classification. Although the TTSP separator (tandem-type classifier) classifies pulverized powder material, according to the manufacturing method of the present invention was found to be effective not only for the classification of pulverized toners, but also the classification of polymerized toners manufactured without the pulverizing step.

2. Fluidizing Agent

In the present invention, the use of a classifier that has a plurality of vane-wheel classifying rotors coaxially in a casing improves the dispersibility of colored polymer particles in a classifying zone, and elevates the accuracy of removing fine particle. At this time, fluidity is previously imparted to the colored polymer particles to prevent the retention and congestion of the colored polymer particles in the classifier for raising the processing capacity, and improving the dispersibility of the colored polymer particles.

A fluidizing agent is organic or inorganic fine particles that functions to enhance the fluidity of material colored polymer particles (toner particles) . The average particle size of the fluidizing agent is smaller than the average particle size of the toner, and is preferably 1 μm or less, more is preferably 500 nm or less, and most preferably 300 nm or less. If the average particle size of the fluidizing agent is excessively large, the fluidity of the colored polymer particles is difficult to enhance sufficiently, and the removal of the fluidizing agent together with fine particles of colored polymer particles becomes difficult.

Examples of organic fine particles that can be used as the fluidizing agent include fine particles of polytetrafluoroethylene, fine particles of polystyrene, fine particles of polymethyl methacrylate, and fine particles of core-shell structure polymer having the core portion consisting of polystyrene-based resin and the shell portion consisting of poly (meth) acrylate-based resin. The weight average particle size of the organic fine particles (measured by a light scattering method) is preferably 0.005 to 1 μm, more preferably 5 to 500 nm, and most preferably 7 to 300 nm.

Inorganic fine particles that can be used as the fluidizing agent are various inorganic fine particles generally used as external additives for improving the fluidity, frictional electrostatic property, transferring property, and wear resistance of the toner. Examples of such inorganic fine particles include fine particles of metal oxide such as silica, titania, alumina, calciumoxide, magnesiumoxide, bariumoxide, beryllium oxide, zinc oxide, and tin oxide; and fine particles of these metal oxide whose surfaces are hydrophobic-treated. Especially, the hydrophobic-treated inorganic fine particles using a hydrophobic-treatment agent have improved humidity resistance, and can provide a stable fluidizing function even in a high-humidity atmosphere.

The average particle size of the primary particles of inorganic fine particles is normally 0.005 to 1 μm, preferably 5 to 500 nm, and more preferably 7 to 300 nm. The primary particles are particles separated to individual unit particles, and the average particle size thereof can be obtained, for example, from the transmission electron microgram (TEM). The volume average particle size of colored polymer particles to be classified (toner) is as small as 3 to 8 μm or 4 to 7 μm, the average particle size of the primary particles of inorganic fine particles used as the fluidizing agent is preferably 5 to 20 nm, and more preferably 7 to 17 nm from the point of view of fluidity improvement.

As inorganic fine particles, fine silica particles are preferable, wherein colloidal silica (fine silica particles manufactured by the gas-phase method) is especially preferable. The surface of the colloidal silica is preferably treated to be hydrophobic using a hydrophobic-treating agent. Examples of hydrophobic-treating agents used for hydrophobic treatment of inorganic fine particles include octyl silane, hexamethyldisilazane, octyl trimethoxy silane, silicone oil, octyl trichlorosilane, decyl trichlorosilane, nonyl trichlorosilane, (4-isopropylphenyl) trichlorosilane, (4-t-butylphenyl) trichlorosilane, dipentyl dichlorosilane, dihexyl dichlorosilane, dioctyl dichlorosilane, dinonyl dichlorosilane, didecyl dichlorosilane, didodecyl dichlorosilane, (4-t-butylphenyl) octyl dichlorosilane, decenyldichlorosilane, dinonenyl dichlorosilane, di-2-ethyl hexyldichlorosilane, di-3,3-dimethyl pentyl dichlorosilane, trihexyl chlorosilane, trioctyl chlorosilane, tridecyl chlorosilane, dioctylmethyl chlorosilane, octyldimethyl chlorosilane, and (4-isopropylphenyl) diethyl chlorosilane. The hydrophobic treatment can be performed by a normal method wherein inorganic fine particles are allowed to react with a hydrophobic-treating agent at a high temperature.

The above-described respective fine particles can be used alone or in combination of two or more as the fluidizing agent. The fluidizing agent is used in the proportion of normally 0.001 to 5 parts by weight, preferably 0.01 to 3 parts by weight, and more preferably 0.03 to 1 part by weight to 100 parts by weight of colored polymer particles (A). If the quantity of the added fluidizing agent is excessively small, the effect of improving fluidity lowers, and if it is excessively large, the method becomes uneconomical.

The addition of the fluidizing agent enhances the fluidity of the colored polymer particles (A), and the degree can be quantitatively evaluated by the "fluidity index". Specifically, the fluidity index of a powder material consisting of the colored polymer particles (A) to which a fluidizing agent is added can be obtained by measuring the repose angle, degree of compaction, spatula angle, degree of coagulation, and degree of uniformity using a Powder Tester PT-R manufactured by Hosokawa Micron Corporation, obtaining each index from each measured value, and totaling the indices. The fluidity index of the powder material to be classified is preferably 10 or more, more preferably 20 or more, and especially preferably 30 or more. The upper limit thereof is about 70 or 60.

The fluidizing agent added to the colored polymer particles (A) is practically completely removed in the classification step together with the fine-particle component of the colored polymer particles (A) . Therefore, when the fluidity of the colored polymer particles (B) (toner) after classification obtained by the manufacturing method of the present invention must be raised, the same kind of fine particles are added as an external additive.

3. Toner

In the present invention, colored polymer particles (A) containing at least a binder resin and a colorant are prepared in Step 1. Colored polymer particles (A) include pulverized toners obtained by a pulverizing method, and polymerized toners obtained by a polymerization method, but are not specifically limited. For example, pulverized toners can be prepared by melting, kneading, and pulverizing a thermoplastic resin together with additive components such as a colorant, a charge control agent, and a releasing agent. Polymerized toners can be prepared by polymerizing a polymerizable monomer composition containing a polymerizable monomer, a colorant, and other additive components in an aqueous medium.

The manufacturing method of the present invention can be applied suitably to polymerized toners. The methods for manufacturing a polymerized toner include suspension polymerization and emulsion polymerization, among which suspension polymerization is preferable because a polymerized toner having a desired particle size can be manufactured. If emulsion polymerization is used, the particle size can be adjusted by coagulating particles after polymerization. Suspension polymerization and emulsion polymerization may be used in combination. Although the polymerized toner can be manufactured using any normal method, the detail will be described below centered on suspension polymerization.

The method for manufacturing the polymerized toner includes a step for polymerizing a polymerizable monomer composition containing at least a colorant and polymerizable monomers in an aqueous medium (also referred to as "aqueous dispersion medium"). Although the polymerizable monomer composition is polymerized to form colored polymer particles, a step for further polymerizing the polymerizable monomers for the shell are further polymerized in the presence of the colored polymer particles to form core-shell structure polymer particles.

As the aqueous medium, water, such as ion-exchanged water, is used; however, a hydrophilic medium, such as alcohol, may be added. In the polymerizable monomer composition, various additives, such as cross-linking monomers, macromonomers, a charge control agent, a release agent, a lubricant, dispersion additives, and a molecular weight modifier, can be contained as needed. To initiate polymerization, a polymerization initiator is used.

(1) Polymerizable Monomer

A monovinyl monomer is generally used as the main component of the polymerizable monomer. Examples of monovinyl monomers include aromatic vinyl monomers such as styrene; (meth) acrylic acid; derivatives of (meth) acrylic acid such as methyl (meth) acrylate, ethyl (meth) acrylate, propyl (meth) acrylate, butyl (meth)acrylate, 2-ethylhexyl (meth)acrylate, cyclohexyl (meth)acrylate, isobonyl (meth)acrylate, dimethylaminoethyl (meth)acrylate, and (meth)acrylamide; monoolefin monomers such as ethylene, propylene, and butylenes; and the mixtures of two or more of these monomers.

The use of a cross-linking monomer and/or a cross-linking polymer each having two or more vinyl groups together with a monovinyl monomer can improve hot-offset properties. The proportion of the cross-linking monomer and/or the cross-linking polymer to 100 parts by weight of the monovinyl monomer is preferably 10 parts by weight or less, and more preferably 0.01 to 7 parts by weight.

The use of a macromonomer together with a monovinyl monomer is preferable because it improves the balance between the shelf stability at high temperatures and the fixation properties at low temperatures. A macromonomer is a giant molecule having polymerizable carbon-carbon unsaturated double bonds at the ends of the molecular chain and is an oligomer or polymer normally having a number average molecular weight of 1,000 to 30,000. The proportion of the macromonomer to 100 parts by weight of the monovinyl monomer is preferably 0.01 to 10 parts by weight, and more preferably 0.03 to 5 parts by weight.

(2) Colorant

Various pigments and dyes used in the field of toners, such as carbon black and titanium white, can be used as a colorant. Examples of a black colorant include pigments and dyes based on carbon black or nigrosin; and magnetic particles such as cobalt, nickel, triiron tetroxide, iron manganese oxide, iron zinc oxide, and iron nickel oxide. As a colorant for color toners, pigments of various colors such as yellow, magenta, and cyan are generally used. The proportion of the colorant to 100 parts by weight of the polymerizable monomer is normally 0.1 to 50 parts by weight, and preferably 1 to 20 parts by weight.

(3) Charge Control Agent

In order to improve the electrostatic property of polymerized toners, it is preferable that the polymerizable monomer composition contains various a charge control agent to positive and negative charge. Examples of a charge control agent include metal complexes of organic compounds having carboxyl groups or nitrogen-containing groups, metal-containing dyes, nigrosin, and antistatic resins. The proportion of the charge control agent to 100 parts by weight of the polymerizable monomer is normally 0.01 to 10 parts by weight, and more preferably 0.1 to 10 parts by weight.

(4) Release Agent

In order to prevent offset or to improve the release property on hot-roll fixation, the polymerizable monomer composition may contain a release agent. Examples of a release agent include polyolefin wax, natural vegetable wax, petroleum-based wax and modified wax thereof, synthetic wax, multifunctional ester compounds such as dipentaerythritol hexamyristate, and the mixtures of two or more of these compounds. The proportion of the a release agent to 100 parts by weight of the polymerizable monomer is normally 0.1 to 50 parts by weight, preferably 0.5 to 20 parts by weight and more preferably 1 to 10 parts by weight.

(5) Lubricant, Dispersion Additive

In order to evenly disperse a colorant, the polymerizable monomer may contain a lubricant such as a fatty acid and a metal salt of a fatty acid; a dispersion additive such as silane-based or titanium-based coupling agent; and the like. The proportion of such a lubricant or dispersion additive relative to-the weight of the colorant is normally in the order of 1/1000 to 1/1.

(6) Polymerization Initiator

Examples of polymerization initiators for polymerizable monomers include persulfates such as potassium persulfate and ammonium persulfate; azo compounds such as 4,4'-azobis(4-cyanovaleric acid), 2,2'-azobis[2-methyl-N-(2-hydroxyethyl) propionamide], 2,2'-azobis(2-amidinopropane) dihydrochloride, 2,2'-azobis(2,4-dimethylvaleronitrile), and 2,2'-azobisisobutyronitrile; and peroxides such as di-t-butyl peroxide, dicumyl peroxide, lauroyl peroxide, benzoyl peroxide, t-butyl peroxy-2-ethylhexanoate, t-hexyl peroxy-2-ethylhexanoate, t-butyl peroxypivalate, di-isopropyl peroxydicarbonate, di-t-butyl peroxyisophthalate, 1,1',3,3'-tetramethylbutyl peroxy-2-ethylhexanoate, and t-butyl peroxyisobutylate. Redox initiators prepared by combining these polymerization initiators and reducing agents can also be used. Among these initiators, it is preferable to select oil-soluble polymerization initiators soluble in the polymerizable monomer. The polymerization initiator is used in the proportion of normally 0.1 to 20 parts by weight, preferably 0.3 to 15 parts by weight to 100 parts by weight of the polymerizable monomer.

The polymerization initiator can be previously added to the polymerizable monomer composition; however, in order to control early polymerization, the polymerization initiator can also be added directly in the suspension after the completion of the step for forming the droplets of the polymerizable monomer composition, or during the polymerization reaction.

(7) Molecular Weight Modifier

Examples of a molecular weight modifier include mercaptans and halogenized hydrocarbons. The molecular weight modifier is used in the proportion of normally 0.01 to 10 parts by weight, preferably 0.1 to 5 parts by weight to 100 parts by weight of the polymerizable monomer.

(8) Dispersion Stabilizer

The colloid of a hardly soluble inorganic compound is preferably used as the dispersion stabilizer. Examples of molecular hardly soluble inorganic compounds include inorganic salts such as barium sulfate,calcium sulfate, barium carbonate, calcium carbonate, magnesium carbonate, and calcium phosphate; inorganic oxides such as aluminum oxide, and titanium oxide; and inorganic hydroxide such as aluminum hydroxide, magnesium hydroxide, and iron (III) hydroxide. Among these, the colloid of a hardly-soluble inorganic hydroxide is preferable since it can narrow the particle size distribution of polymer particles, and the sharpness of images is improved.

As the colloid of the hardly soluble inorganic compound, it is preferable to use the colloid of a hardly-soluble inorganic hydroxide obtained by adjusting the pH of the aqueous solution of a water-soluble multivalent inorganic compound to 7. It is preferable that the number particle-size distribution D50 (50% cumulative value of number particle-size distribution) of the colloid of the hardly-soluble inorganic compound is 0.5 μm or less, and D90 (90% cumulative value of number particle-size distribution) is 1 μm or less. The dispersion stabilizer is used in the proportion of normally 0.1 to 20 parts by weight to 100 parts by weight of the polymerizable monomer.

In the present invention, other dispersion stabilizers such as a water-soluble polymer can also be used. A surfactant can also be used as long as the environment dependence of electrostatic properties is not enhanced.

(9) Polymerization Step

The polymerized toner is composed of colored polymer particles wherein a colorant and additives, such as a charge control agent and a release agent, are dispersed in a binder resin formed by the polymerization of polymerizable monomers. By using the colored polymer particle as a core, and forming a shell composed of a polymer layer, a core-shell structure polymer particle can be formed.

The polymerized toner can be obtained, for example, through the following steps: A polymerizable monomer, a colorant, and other additives are mixed using a mixer, and wet-ground using a media-type wet-grinding machine as required, to prepare a polymerizable monomer composition. Next, the polymerizable monomer composition is dispersed in an aqueous dispersion medium containing a dispersion stabilizer and is agitated to form uniform droplets of the polymerizable monomer composition (primary droplets of a volume average particle size of about 50 to 1000 μm). It is preferable that the polymerization initiator is added to the aqueous dispersion medium after the size of the droplets has become uniform.

The polymerization initiator is added and mixed in the suspension wherein the droplets of the polymerizable monomer composition are dispersed in the aqueous dispersion medium, and the suspension is further agitated using a high-speed rotating shear-type agitator until the particle size of the droplets becomes a small particle size close to the particle size of the target polymerized toner. The suspension containing thus formed droplets of small particle sizes (secondary droplets having a volume average particle size of about 1 to 12 μm) is charged in a polymerization reactor, and suspension polymerization if preformed at a temperature normally between 5 and 120° C., preferably between 35 and 95° C.

Colored polymer particles wherein additive components such as a colorant are dispersed in the polymer of polymerizable monomers are formed by suspension polymerization. Although these colored polymer particles can be used as a polymerized toner, a polymer layer can be further formed on the colored polymer particles obtained by suspension polymerization to be a capsule toner having a core-shell structure, in order to improve the shelf stability (anti-blocking), low temperature fixation, and melting properties on fixation.

The preferable method for forming the core-shell structure is a method wherein the above-described colored polymer particles are used as core particles, and polymerizable monomers for the shell are further polymerized in the presence of the core particles to form a polymer layer (shell) on the surface of a core particle. The use of a polymer having the glass transition temperature (Tg) higher than the Tg of the polymer component composing the core particles as the polymerizable monomer for the shell can improve the shelf stability of the polymerized toner. The weight ratio of the polymerizable monomer for the core to the polymerizable monomer for the shell is normally 40/60 to 99.9/0.1, and preferably 60/40 to 99.7/0.3.

It is preferable that the polymerizable monomer for the shell is added in the polymerization reaction system as droplets smaller than the average particle size of core particles. The reduction of the particle size of the droplets of the polymerizable monomer for the shell facilitates the formation of a uniform polymer layer around a core particle. In order to form small droplets from the polymerizable monomer for the shell, the mixture of the polymerizable monomer for the shell and the aqueous dispersion medium is subjected to micro dispersion treatment, for example, using an ultrasonic emulsifier, and the obtained dispersion is added to the polymerization reaction system. A charge control agent can be added to the polymerizable monomer for the shell as required.

In order to manufacture a polymerized toner of a core-shell structure, a polymerizable monomer for the shell or the aqueous dispersion thereof is added to a suspension containing core particles at once, continuously, or intermittently. When the polymerizable monomer for the shell is added, it is preferable to add a water-soluble radical initiator for efficiently forming the shell. Examples of water-soluble radical initiators include persulfates and azo-based initiators such as 2,2'-azobis[2-methyl-N-(2-hydroxyethyl) propionamide]. The water-soluble polymerization initiator is used in the proportion of normally 0.1 to 50 parts by weight, preferably 1 to 20 parts by weight to 100 parts by weight of the polymerizable monomer for the shell. The average thickness of the shell is normally 0.001 to 1.0 μm, and preferably 0.003 to 0.5 μm.

(10) Polymerized Toner

Although the volume average particle size (dv) of the polymerized toner (including a core-shell structure polymerized toner) is not specifically limited, in the case of the toner of a small particle size, the dv is preferably 10 μm or less, more preferably 2 to 10 μm, further preferably 3 to 8 μm, and most preferably 4 to 7 μm. The particle size distribution represented by the volume average particle size (dv) /number average particle size (dp) of the polymerized toner is normally 1.7 or less, preferably 1.5 or less, and more preferably 1.3 or less. If the volume average particle size of the polymerized toner is excessively large, the resolution becomes easy to lower. If the particle size distribution is large, the proportion of the toner of large particle sizes increases, and the resolution becomes easy to lower.

The polymerized toner is preferably substantially spherical as demonstrated by the ratio (dl/ds) of the major axis (dl) to the minor axis (ds) of preferably 1 to 1.3, and more preferably 1 to 1.2. The use of the polymerized toner composed of substantially spherical particles improves the transfer efficiency to the transfer material of toner images of the photoreceptor.

(11) Classified Color Particles (Toner)

According to the manufacturing method of the present invention, the toner can be obtained as colored polymer particles (B) whose particle size distribution is adjusted through the classification step. According to the manufacturing method of the present invention, even the toner of small particle size can significantly improve the efficiency of removing fine particles, and can raise the yield after classification. According to the manufacturing method of the present invention, through the one-pass classification (classification treatment in the continuous method), classification can be performed, for example, in the treatment capacity of 80 kg/h or more, preferably 100 kg/h or more, and more preferably 120 kg/h or more.

According to the manufacturing method of the present invention, the product yield in the classification step can be raised to 75% or more, preferably to 80% or more. According to the manufacturing method of the present invention, even if the toner has a of small particle size as the volume average particle size (dv) is 10 μm or less, or 3 to 8 μm or 4 to 7 μm, the toner of the content of fine particles smaller than the volume average particle size can be obtained. For example, in the case of the polymerized toner having a volume average particle size (dv) of 4 to 7 μm, according to the manufacturing method of the present invention, the toner having the number content of fine particles of a particle size not more than 3.17 μm as significantly small as 4% or less, preferably 3% or less, and more preferably 2% or less, and a sharp particle size distribution.

The toner obtained according to the manufacturing method of the present invention can be used as the toner component of various developers. In the case of the polymerized toner, the toner is preferably used as anon-magnetic single-component developer. When the polymerized toner is used as a non-magnetic single-component developer, various external additives can be mixed. Examples of external additives include inorganic fine particles such as silica and organic fine particles that function as a fluidizing agent or a polishing agent. The external additive is used in the proportion of normally 0.1 to 6 parts by weight to 100 parts by weight of the polymerized toner. In order to adhere the external additive to the polymerized toner, normally the polymerized toner and the external additive are agitated in a mixer such as a Henschel mixer.

Advantages of the Invention

According to the present invention, there is provided a method for manufacturing a toner that can be classified to desired size distribution, and can form high-quality images of high density and little fog even after continuous printing. Particularly according to the present invention, there is provided a method for manufacturing a toner that can efficiently remove fine particles by classification even it is a toner with a strongly coagulating small particle size, and obtain a high-quality toner at a high yield.

EXAMPLES

The present invention will be described below in further detail referring to examples and comparative examples. Unless otherwise specified, "part" and "%" are indicated by weight (mass). Methods for measurements were as follows:

(1) Measurement of Average Particle Size

The volume-average particle size (dv) , number-average particle size (dp), and particle size distribution (dv/dp) of the polymerized toner was measured using a Multisizer (manufactured by Beckman Coulter, Inc.). The measurement using the Multisizer was conducted under the conditions of: aperture diameter=100 μm, medium=Isoton II, concentration=10% and the number of measured particles=100,000.

(2) Measurement of Fluidity Index

The fluidity index of the toner was measured according to a normal method using a Powder Tester PT-R manufactured by Hosokawa Micron Corporation by measuring the angle of repose, condensation, spatula angle, coagulation, and uniformity, and totaling respective index obtained from each measured value.

(3) Evaluation of Printing Quality

The printing density and fog were evaluated by charging the toner in a commercially available non-magnetic single-component printer, and continuously printing 10,000 sheets of paper under ambient conditions of a temperature of 23 °

C. and a relative humidity of 50%. The printing density was evaluated by printing without space on the 10,000th sheet, and measuring the "solid area" using a Macbeth reflection density meter. Fog was evaluated by measuring the fog on the non-image area of copying paper printed on the 10,000th sheet using a whiteness meter (manufactured by Nippon Denshoku Industries Co. , Ltd.) Fog can be calculated from whiteness after printing (B) and whiteness before printing (A) using the formula, Fog=(B−A). The evaluation of image quality wad indicated by interrupting printing after printing 500 sheets during continuous printing, visually observing the copying paper, and counting the number of sheets when the image quality became obviously degraded compared with the initial image quality.

Example 1

1. Toner Preparation Step

A polymerizable monomer consisting of 80.5 parts of styrene and 19.5 parts of n-butyl acrylate (Tg of the copolymer obtained by copolymerizing these monomers=55° C.), 0.3 part of polymethacrylic acid ester macromonomer (manufactured by Toagosei Co., Ltd.; trade name: AA6; Tg=94° C.), 0.5 part of divinyl benzene, 1.2 parts of t-dodecyl mercaptan, 7 parts of carbon black (manufactured by Mitsubishi Chemical Corporation; trade name: #25B) , and 7 parts of an antistatic resin (manufactured by Fujikura Kasei Co., Ltd.; trade name: FCA-626M were wet-ground using a media-type wet-grinding machine to prepare a polymerizable monomer composition for the core.

Separately, an aqueous solution of 6.2 parts of sodium hydroxide in 50 parts of ion-exchanged water was slowly added while agitating to an aqueous solution of 10.2 parts of magnesium chloride in 250 parts of ion-exchanged water to prepare a dispersion of magnesium hydroxide colloid. The particle size distribution of the formed colloid was measured using an SALD particle size distribution measuring instrument (manufactured by Shimadzu Corporation), and D50 (50% cumulative value of number particle-size distribution) and D90 (90% cumulative value of number particle-size distribution) were 0.35 μm and 0.62 μm, respectively.

On the other hand, 2 parts of methyl methacrylate (Tg=105° C.) and 65 parts of water were subjected to a micro-dispersion treatment using an ultrasonic emulsifier to prepare an aqueous dispersion of a polymerizable monomer for the shell. The particle size of a droplet of the polymerizable monomer for the shell was 1.6 μm in D90.

The polymerizable monomer composition for the core was fed into the dispersion of magnesium hydroxide colloid prepared as described above (colloid quantity=9.0 parts), and was agitated until droplets stabilized. After adding to this dispersion 6 parts of t-butyl peroxy-2-ethylhexanoate (manufactured by NOF Corporation; trade name: Perbutyl O) to this dispersion, the dispersion was agitated under high shearing using a high shear agitator (manufactured by Ebara Corporation; trade name: Ebara Milder) to form the droplets of the polymerizable monomer composition for the core.

One part of sodium tetraborate decahydrate was added to the dispersion of magnesium colloid wherein the droplets of the polymerizable monomer composition for the core were dispersed, fed in a reactor equipped with stirring blades, allowed to initiate polymerization reaction at 85° C., and after the polymerization conversion had reached substantially 100%, the above-described aqueous dispersion of polymerizable monomer for the shell, and 0.3 part of an aqueous initiator (manufactured by Wako Pure Chemical Industries, Ltd.; trade name: VA-086=2,2'-azobis[2-methyl-N-(2-hydroxyethyl)-propionamide] dissolved in 20 parts of ion-exchanged water were added. After continuing polymerization of 4 hours, reaction was discontinued to obtain an aqueous dispersion containing core-shell structure colored polymer particles.

While agitating the aqueous dispersion of the colored polymer particles obtained as described above, sulfuric acid was added for acid cleaning at the pH of 4 or below, and after water was separated by filtration, 500 parts of ion-exchanged water was newly added to form slurry again, and water cleaning was performed. Thereafter, dehydration and water cleaning were repeated several times to filter and separate solid contents, and dried in a dryer at 45° C. for 2 days to obtain colored polymer particles. The particle size of the obtained colored polymer particle was measured and found that the volume average particle size (dv) was 5.81 μm, the number average particle size (dp) was 4.42 μm, the size distribution (dv/dp) was 1.32, and the number content of particles having diameters of 3.17 μm or below was 23.5%.

2. Classification Step

To 100 parts of colored polymer particles before classification prepared as described above, 0.1 part of hydrophobic-treated fine silica particles (manufactured by Nippon Aerosil Co., Ltd.; trade name: AEROSIL RX-200; average particle size of primary particles=12 nm) was added and mixed to prepare a powder material of a fluidity index of 45. This powder material was classified using a classifier (TTSP separator) shown in FIG. 1. The classifying conditions were a rotation speed of each classifying rotor of 5,000 rpm, and a quantity of air of 22 $m^3$/min. As a result, a toner of a volume average particle size (dv) of 5.75 μm, and a number content of particles of 3.17 μm or below of 1.7% in the treatment capacity of 150 kg/h was obtained at a product yield of 81.5%.

3. Developer

To 100 parts of the toner obtained as described above, 1.5 parts of hydrophobic-treated fine silica particles (manufactured by Nippon Aerosil Co., Ltd.; trade name: AEROSIL RX-200; average particle size of primary particles=12 nm), and 1.0 part of hydrophobic-treated fine silica particles (manufactured by Nippon Aerosil Co., Ltd.; trade name: AEROSIL RX-50; average particle size of primary particles=40 nm) were added, and were mixed using a Henschel mixer (manufactured by Mitsui Mining Co., Ltd.) to manufacture a non-magnetic single-component developer. The results are shown in Table 1.

Comparative Example 1

When classification was performed using a TTSP separator under the same conditions as in Example 1, except that fine silica particles were not added to colored polymer particles before classification in the classification step, stable operation became difficult at the treatment capacity of 75 kg/h or more. Therefore, when classification was performed at the treatment capacity of 75 kg/h or less, the toner of a volume average particle size (dv) of 5.66 μm, and a number content of particles of 3.17 μm or below of 4.8% was obtained at a product yield of 78.2%. The results are shown in Table 1.

Comparative Example 2

When classification was performed under the same conditions as in Example 1, except that a TSP separator (refer to Japanese Patent Laid-Open No.2001-104888) was used as the classifier in place of the TTSP separator, both the treatment capacity and product yield were the same levels as in Example 1; however, the number content of the obtained toner of 3.17 μm or less was as high as 6.9%, and only the toner producing fog and having insufficient continuous printing properties and image quality could be obtained. The volume average particle size (dv) of the toner was 5.65 μm. The results are shown in Table 1.

Comparative Example 3

When classification was performed under the same conditions as in Example 1, except that an elbow-jet classifier (refer to Japanese Patent Laid-Open No. 2000-42494) was used as the classifier in place of the TTSP separator, the treatment capacity was the same level as in Example 1; however, the number content of the obtained toner of 3.17 μm or less was as high as 7.5%, and only the toner producing fog and having insufficient continuous printing properties and image quality could be obtained. In this classification method, the product yield was as low as 72.1%. The volume average particle size (dv) of the toner was 5.63 μm. The results are shown in Table 1.

TABLE 1

| | Example 1 | Comp. Ex. 1 | Comp. Ex. 2 | Comp. Ex. 3 |
|---|---|---|---|---|
| Classifier | TTSP | TTSP | TSP | Elbow jet |
| Fluidity index | 45 | 2 | 45 | 45 |
| Treatment capacity (kg/h) | 150 | 75 | 150 | 150 |
| Product yield (%) | 81.5 | 78.2 | 80.0 | 72.1 |
| Number content of particles of 3.17 μm or below in product (%) | 1.7 | 4.8 | 6.9 | 7.5 |
| Evaluation of printing | | | | |
| Density | 1.51 | 1.49 | 1.50 | 1.48 |
| Fog | 2.0 | 8.5 | 11.0 | 14.0 |
| Image quality | ≧10,000 | 7,000 | 2,000 | 1,000 |

What is claimed is:

1. A method for manufacturing a toner composed of colored polymer particles (B) whose particle-size distribution is adjusted, comprising Step 1 for preparing colored polymer particles (A) that contain at least a binder resin and a colorant, and Step 2 for classifying said colored polymer particles (A), wherein said Step 2 is a step for performing classification by:

(i) using a classifier that has a plurality of vane-wheel classifying rotors coaxially in a casing; enables the rotating speed of each classifying rotor to be set to be the same as or different from each other; and can simultaneously perform a plurality of stages of classification corresponding to each classifying rotor; and (ii) feeding a powder material comprising colored polymer particles (A), to which a fluidizing agent is added, to said classifier, wherein the average particle size of the fluidizing agent is smaller than the average particle size of the toner, and is 500 nm or less, the powder material is a material wherein 0.01 to 3 parts by weight of the fluidizing agent is added to 100 parts by weight of the colored polymer particles (A), and the fluidity index of the powder material to be classified is 10 or more;

and further wherein the fluidizing agent added to the colored polymer particles (A) is practically completely removed in the Step 2 together with the fine-particle component of the colored polymer particles (A), thereby obtaining colored polymer particles (B), whose number content of fine particles of 3.17 μm or less is 3% or less.

2. The manufacturing method according to claim 1, wherein the classifier has a tandem structure having two vane-wheel classifying rotors disposed coaxially and vertically in a casing.

3. The manufacturing method according to claim 2, wherein the classifier having a tandem structure is a tandem-type classifier having two motor-driven vane-wheel classifying rotors, each of which is mounted on one side in a common casing, and each provided with a tangential classifying-air intake at the level of respective classifying rotor; having a stationary guide vane ring that is positioned at a radial distance from the circumference of the classifying rotor; and having a feeder of the material to be classified, exit ports for discharging classified fractions, and a classifying zone through which a stream of the classified fractions flows along the direction of the longitudinal axis of the classifying rotor.

4. The manufacturing method according to claim 3, wherein the classifier having a tandem structure comprises two vane-wheel classifying rotors, each of which is provided with a closed cover disc at a first axial end thereof, and with a fine and medium fraction discharge port at a second axial end thereof; and the first end of each classifying rotor is disposed so as to face to each other, and a minute flow gap is formed in the axial direction thereof.

5. The manufacturing method according to claim 1, wherein the colored polymer particles (A) have a volume average particle size of 10 μm or less, and a particle size distribution of 1.7 or less.

6. The manufacturing method according to claim 5, wherein the colored polymer particles (A) have a volume average particle size of 3 to 8 μm.

7. The manufacturing method according to claim 5, wherein the colored polymer particles (A) have a volume average particle size of 4 to 7 μm.

8. The manufacturing method according to claim 1, wherein the colored polymer particles (A) are colored polymer particles obtained by polymerizing a polymerizable monomer composition containing at least a colorant and a polymerizable monomer in an aqueous medium in Step 1.

9. The manufacturing method according to claim 1, wherein the colored polymer particles (A) are core-shell structure polymer particles obtained by first forming colored polymer particles by polymerizable monomer composition containing at least a colorant and a polymerizable monomer in an aqueous medium in Step 1, and then further polymerizing a polymerizable monomer for the shell in the presence of said colored polymer particles.

10. The manufacturing method according to claim 1, wherein the fluidizing agent is organic or inorganic fine particles having an average particle size smaller than the average particle size of the toner.

11. The manufacturing method according to claim 1, wherein the fluidizing agent is inorganic fine particles having an average particle size of primary particles of 7 to 300 nm.

12. The manufacturing method according to claim 1, wherein the fluidizing agent is fine particles of a metal oxide, or fine particles of a metal oxide whose surface is treated to be hydrophobic.

13. The manufacturing method according to claim 1, wherein the powder material is a material wherein 0.03 to 1 parts by weight of a fluidizing agent is added to 100 parts by weight of the colored polymer particles (A).

14. The manufacturing method according to claim 1, wherein the powder material has a fluidity of 30 or more.

15. The manufacturing method according to claim 1, wherein the powder material is a material wherein inorganic fine particles having an average particle size of primary particles of 5 to 20 nm are added as the fluidizing agent to colored polymer particles (A) of a volume average particle size of 4 to 7 μm.

16. The manufacturing method according to claim 1, wherein the powder material composed of colored polymer particles (A) of a volume average particle size of 4 to 7 μm to which a fluidizing agent is added is classified, to obtain colored polymer particles (B) having a volume average particle size of 4 to 7 μm and the number content of fine particles of 3.17 μm or less is 2% or less.

* * * * *